US005520462A

United States Patent [19]

Clark

[11] Patent Number: 5,520,462

[45] Date of Patent: May 28, 1996

[54] CARRYING CASE FOR CARRYING A MUSIC STAND AND MUSIC ON A MUSICAL INSTRUMENT CASE

[76] Inventor: Glen W. Clark, 3915 180th SE., Bothell, Wash. 98012

[21] Appl. No.: 196,947

[22] Filed: Feb. 15, 1994

[51] Int. Cl.[6] ..... B65D 33/14

[52] U.S. Cl. ..... 383/37; 84/453; 190/102

[58] Field of Search ..... 190/102, 108; 84/453; 383/37

[56] References Cited

U.S. PATENT DOCUMENTS

| | | | |
|---|---|---|---|
| 296,993 | 4/1884 | Moffly . | |
| 622,722 | 4/1899 | Smith . | |
| 867,403 | 10/1907 | Newson | 190/102 |
| 2,707,035 | 4/1955 | Lashley | 190/52 |
| 2,813,602 | 11/1957 | MacArthur, Jr. | 190/108 |
| 3,837,447 | 9/1974 | Honan | 190/108 |
| 4,094,351 | 6/1978 | Catenaccio | 150/7 |
| 4,436,189 | 3/1984 | Baum | 190/108 |
| 4,442,960 | 4/1984 | Vetter | 224/32 A |
| 4,535,922 | 8/1985 | Yarnold | 224/202 |
| 4,592,091 | 5/1986 | Italici | 383/15 |
| 4,852,778 | 8/1989 | Beiser et al. | 224/30 A |
| 4,911,271 | 3/1990 | Stanley | 190/102 |
| 5,050,713 | 9/1991 | Lee | 190/108 |
| 5,174,481 | 12/1992 | LeDune | 224/202 |
| 5,215,379 | 6/1993 | Pickard et al. | 383/37 |
| 5,263,618 | 11/1993 | Talavera | 224/148 |
| 5,354,131 | 10/1994 | Mogil | 190/107 |

FOREIGN PATENT DOCUMENTS

| | | | |
|---|---|---|---|
| 1195440 | 11/1959 | France | 190/102 |
| 3033327 | 4/1982 | Germany | 383/37 |
| 2257028 | 1/1993 | United Kingdom | 190/102 |

*Primary Examiner*—Stephen P. Garbe

*Attorney, Agent, or Firm*—Christensen O'Connor Johnson & Kindness

[57] ABSTRACT

A pair of bags for carrying sheet music and a music stand on a musical instrument case. One of the bags is configured to carry the music stand, while the other saddlebag is configured to carry the sheet music. Each bag includes one or more straps that extend over the musical instrument case and attach the bags to the musical instrument case. Each of the straps includes a hook-and-latch-type fastener that releasably attaches the bags to each other or the musical instrument case. The opening in each of the bags is releasably closed with a hook and latch type fastener. The bags may be individually attached to the musical instrument case or may be attached to each other and then placed over the musical instrument case.

5 Claims, 2 Drawing Sheets

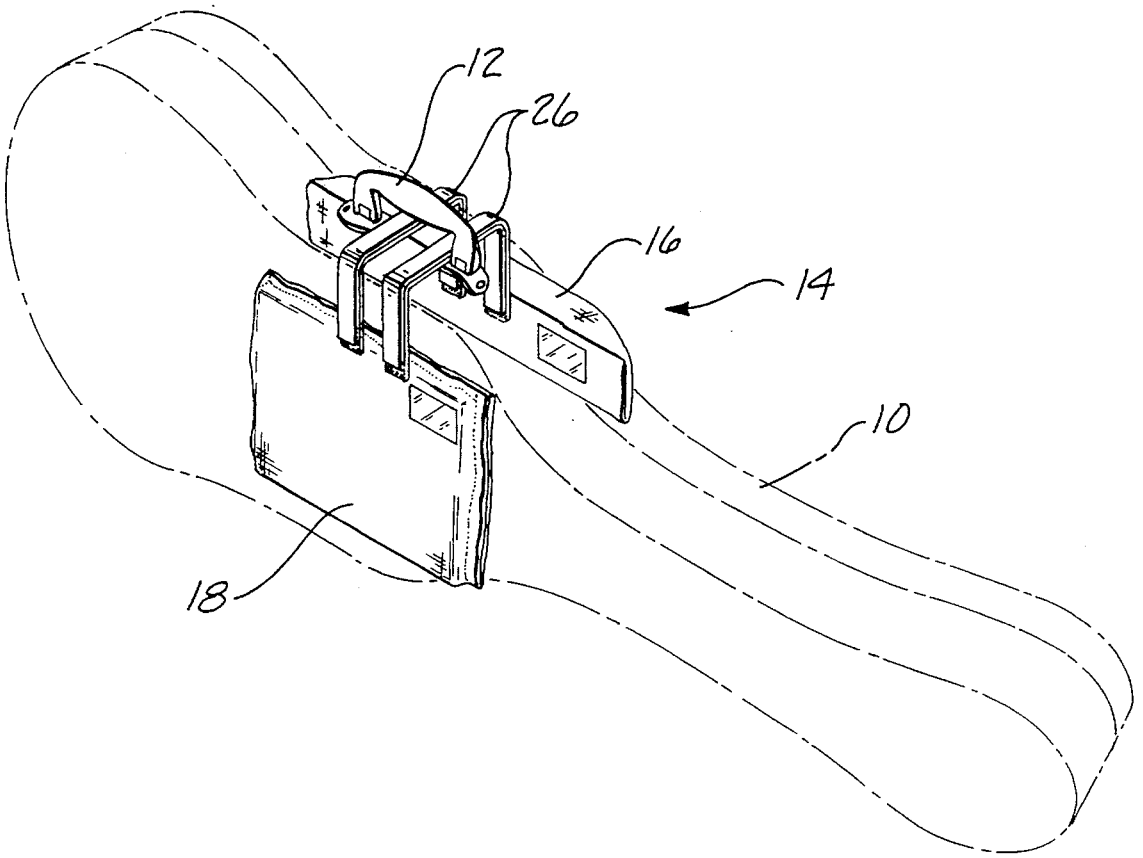
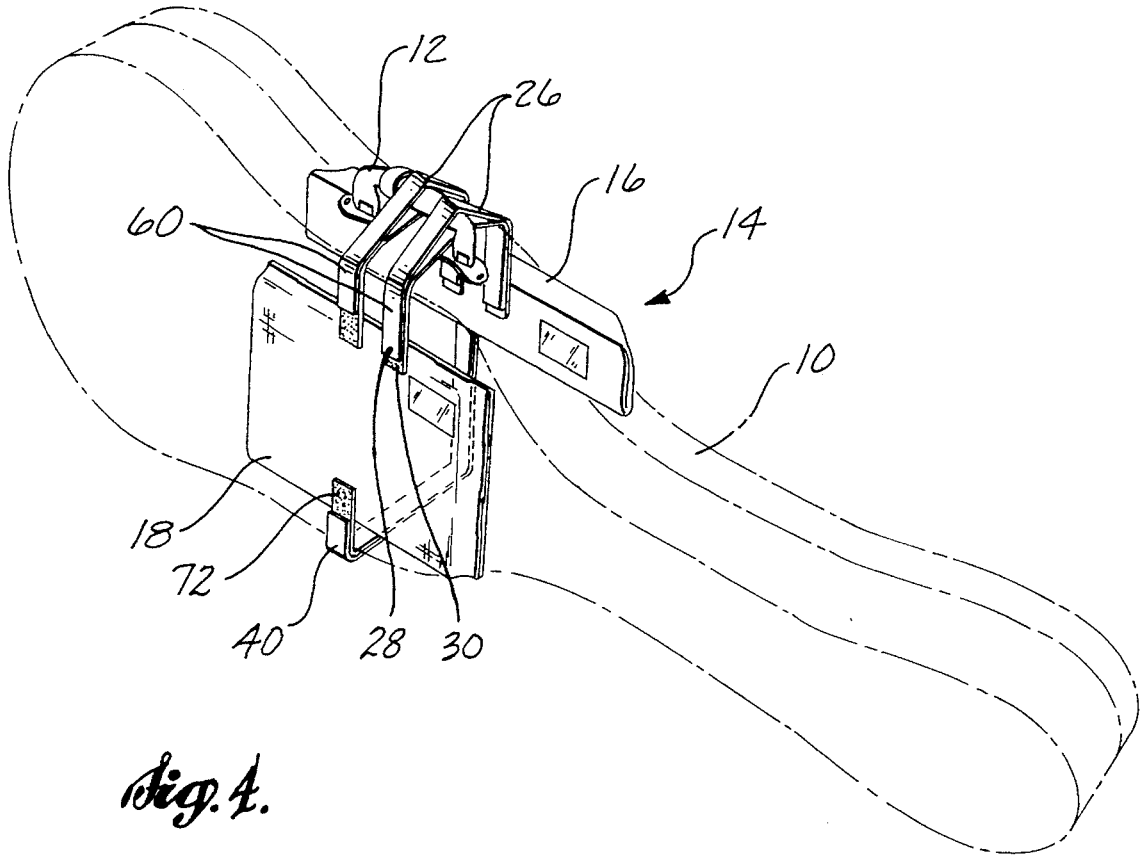
Fig. 4.

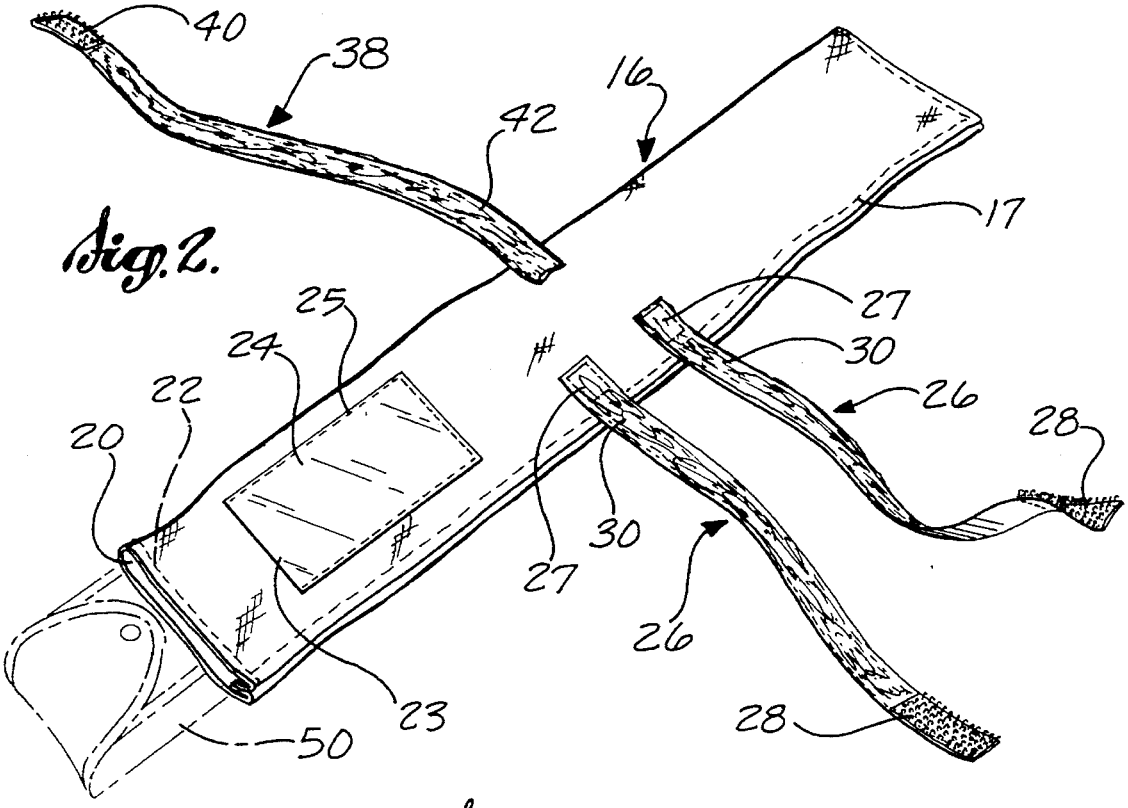
Fig. 2.
Fig. 3.
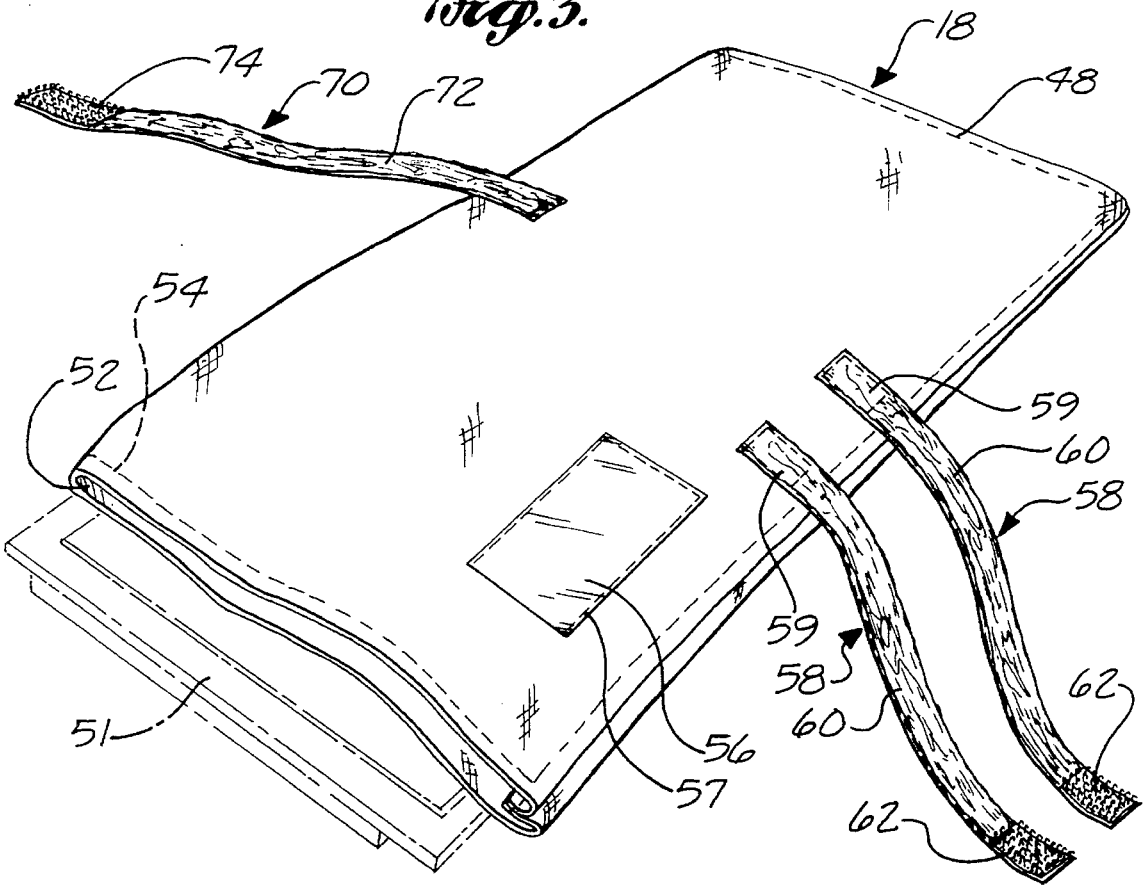

CARRYING CASE FOR CARRYING A MUSIC STAND AND MUSIC ON A MUSICAL INSTRUMENT CASE

FIELD OF THE INVENTION

The present invention relates to apparatus for carrying sheet music and musical equipment, such as a music stand.

BACKGROUND OF THE INVENTION

Musicians have long been burdened and inconvenienced when moving their musical instrument, music, such as sheet music, and music stand from performance to performance. The ease with which a musician transports the musical equipment differs depending on which instrument, thus size and shape of the musical instrument case, the musician plays. In the case of larger instruments such as guitars, cellos, French horns, tubas, etc., it can be difficult, if not impossible, for a musician to carry all of the equipment in a single trip.

Often, the musical instrument case by itself is heavy, bulky, and difficult to carry even without attempting to also carry a music stand or sheet music. This difficulty is further exacerbated by the fact that often a musician needs to carry items in addition to the musical instrument, music stand, and sheet music. It would be beneficial to the musician if the musical instrument, sheet music, and music stand could be integrated into a single unit that could be carried using one hand, thus freeing up the musician's other hand to carry additional items or open doors, etc.

To reduce some of the problems associated with carrying musical equipment, carriers have been designed to include straps that surround a music stand. One such carrier is disclosed in U.S. Pat. No. 4,535,922, issued to Yarnold. Although the carrier disclosed in Yarnold helps a musician carry music stands, it does not allow a musician to combine the musical instrument, musical stand, and sheet music into a single unit. The Yarnold carrier also has a stiff support brace and is fairly bulky, thus adding to the amount of equipment the musician must carry.

It would be beneficial to musicians to have a carrier that would allow the musical instrument case, music stand, and sheet music to be combined into a single unit. One of the goals of the present invention is to provide such a carrier.

SUMMARY OF THE INVENTION

The present invention allows a music stand and sheet music to be attached to a musical instrument case, thus allowing the musician to carry the musical instrument, music stand, and sheet music gripping only the handle on the musical instrument case. The invention includes a holder that receives and holds the music stand and a holder that receives and holds the sheet music. Both of the holders include at least one strap that extends outwardly from one edge of the holder and attaches the holders to the musical instrument case.

According to one aspect of the invention, the straps extend over a portion of the musical instrument case and interconnect to each other in order to attach both holders to the musical instrument case in a saddlebag configuration. Both the holders include openings that are releasably sealed by fastening means that include a hook-and-latch-type fastener. Either of the holders may include at least two straps extending from opposite edges of the holder. One of the straps extends under the musical instrument case and attaches the bottom edge of one of the holders to the bottom edge of the other holder. One embodiment of the present invention is formed of a flexible material, thus allowing the invention to be easily folded and stored when not in use.

The present invention allows a musician to carry a musical instrument, sheet music, and music stand using the handle on the musical instrument case. Thus, the invention frees up the musician's additional hand to carry other equipment or open doors, etc.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein:

FIG. 1 is a perspective view of a musical instrument case, and music stand and sheet music carrier according to the present invention;

FIG. 2 is a perspective view of a holder for carrying a music stand according to the present invention;

FIG. 3 is a perspective view of a holder for carrying sheet music according to the present invention;

FIG. 4 is a perspective view illustrating one method of attaching the music stand and sheet music holder of the present invention to a musical instrument case.

DETAILED DESCRIPTION OF THE PREFERRED EMBODIMENT

A preferred embodiment of a carrier 14 for carrying a music stand and sheet music according to the present invention is illustrated in FIG. 1 attached to a musical instrument case 10 (shown in phantom), such as a guitar case. The carrier 14 includes a music stand holder 16 configured to contain a music stand 50 (shown in phantom in FIG. 2) and a music holder 18 configured to hold sheet music, such as sheet music 51 (shown in phantom in FIG. 3) or other musical supplies. Both the music stand holder 16 and music holder 18 may be attached individually to the musical instrument case 10 or may be attached to each other and then to the musical instrument case 10 as described below. The carrier 14 allows a musician to carry the musical instrument case 10, music stand 50, and sheet music 51 using the handle 12 on the musical instrument case.

The details of the music stand holder 16 are best illustrated in FIG. 2. The music stand holder 16 is rectangular in shape, with the length dimension being much greater than the width dimension to allow the music stand to be placed inside the music stand holder. The music stand holder 16 may be formed of any suitable material capable of supporting the music stand and of providing desirable wear characteristics. Some usable materials include various cloth or leather materials. The preferred embodiment of the invention is formed by folding a sheet of a flexible material, such as a cloth material, lengthwise and then sewing two edges of the sheet together inwardly from the edges of the material, as shown by stitch lines 17. The third edge of the folded sheet is not sewn together and thus forms an opening 20 sized to receive the music stand into one end of the holder. After sewing two edges of the folded sheet together, the sheet is turned inside out to form the music stand holder 16. Alternately, the music stand holder 16 could be formed of two or more sheets of material joined along the edges by sewing, adhesive bonding, or another form of fastening.

It is advantageous that the music stand holder 16 include a fastening mechanism 22 near the edge of the opening 20, so that the opening may be secured in a closed position after the music stand has been inserted into the music stand holder. In the preferred embodiment, the fastening mechanism 22 is a hook-and-latch-type fastener, such as that sold under the trademark Velcro®, placed inside the periphery of the opening 20. Alternative fastening mechanisms, including zippers, buttons, pullcords, etc., could also be used.

The music stand holder 16 includes a transparent pocket 24 located near one end of the holder. The transparent pocket 24 includes an opening 23 into which a document containing the musician's identification or other information may be inserted. In the preferred embodiment, the transparent pocket 24 is formed by attaching a transparent material, such as a flexible plastic material, to at least one side of the music stand holder 16 along three edges by sewing as illustrated by stitch lines 25. Alternately, the transparent material could be adhesively bonded to the side of music stand holder 16 or attached with other fastening means well known in the art.

In order to attach the music stand holder 16 to the musical instrument case 10, an attachment mechanism, such as the two straps 26, shown in the preferred embodiment are used. Both straps 26 are formed of a flexible material, such as a cloth or leather material, and are attached along one side of the music stand holder 16 by sewing the ends of the straps to the holder shown by stitch lines 27. Alternately, the straps 26 could be adhesively bonded, bolted, riveted, or otherwise fastened to the music stand holder 16. The straps 26 can be used to attach the music stand holder 16 directly to the handle 12 on the musical instrument case 10 or to attach the music stand holder to the music holder 18 and then to the musical instrument case as described in more detail below.

In the preferred embodiment, the straps 26 attach the music stand holder 16 to either the musical instrument case 10 or the music holder 18 using a hook-and-latch-type fastener, such as that sold under the trademark Velcro®. The outer portion of each strap 26, furthest from the edge of the music stand holder 16, includes the hook portion 28 of the hook-and-latch fastener while the inner portion of each strap 26 includes the latch portion 30 of the hook-and-latch-type fastener. The music stand holder 16 may also optionally include a third strap 38 attached near the opposite edge of the music stand holder 16 as described below.

Alternatively, one of the straps on the music stand holder or music holder could be formed entirely of the hook portion of the fastener and the other strap formed entirely of the latch portion of the fastener. The straps could then be fastened together to attach the holders to the musical instrument case or could be fastened to the straps on the other holder as described below.

One method of attaching the music stand holder 16 to the musical instrument case 10 is illustrated in FIG. 4. In this method, the outer hook portions 28 of the straps 26 are slid under the handle 12 and then looped over the top of the handle 12 such that the hook portion 28 of each strap engages the latch portion 30 of the same strap, thus maintaining the music stand holder 16 and thus music stand 50 attached to the handle of musical instrument case 10.

The music holder 18 is constructed in a manner similar to the music stand holder 16, but is configured to hold sheet music or music books, etc. Features of the music holder 18 not discussed below are similar to the respective features of the music stand holder 16 and may be understood by reference to the disclosure thereof. The music holder 18 may be formed of any suitable material, including various cloth or leather materials. It is advantageous that both the music stand holder 16 and music holder 18 be formed of a flexible material, such that the holders may be easily folded and stored in the musical instrument case 10 or other location when not in use.

The preferred embodiment of the music holder 18 is formed by folding a sheet of cloth material lengthwise and then sewing the sheet together along two edges as shown by stitch lines 48. The sewn sheet is then turned inside out to form the music holder 18. The third edge of the music holder 18 is left unsewn thus forming an opening 52 at one end of the music holder. The opening 52 is sized to allow sheet music 51 to be placed within the music holder 18. Alternately, the music holder 18 could be formed of two or more sheets of material joined by sewing, adhesive bonding, or other forms of fastening.

A fastening mechanism 54 is located near the edge of the opening 52 in order to positively close the music holder 18 and maintain the sheet music within the music holder. In the preferred embodiment, the fastening mechanism is a hook-and-latch-type fastener, such as that sold under the trademark Velcro®, however, other fastening mechanisms including zippers, buttons, pullcords, etc., could also be used.

A transparent pocket 56 is located near one comer of the music holder 18 and is configured to hold documents containing the musician's identification or other information. The transparent pocket 56 may be formed by sewing a sheet of a transparent material to the surface of the music holder 18 along stitch lines 59. Alternately, the transparent material could be attached by adhesive bonding or other attachment means.

In order to attach the music holder 18 to the musical instrument case 10 or the music stand holder 16, an attachment mechanism, such as the two straps 58, shown in the preferred embodiment are used. Both straps 58 are formed of a flexible material, such as a cloth or leather material, and are attached along one edge of the music holder 18 by sewing the ends to the music holder as illustrated by stitch lines 59. Alternately, the straps 58 could be attached by adhesive bonding, bolting, riveting, or other fastening means. The straps 58 may be used to attach the music holder 18 directly to the handle of the musical instrument case 10 or to the music stand holder 16 and then to the musical instrument case as described below.

In the preferred embodiment, the straps 38 attach the music holder 18 to either the musical instrument case 10 or the music stand holder 16 using a hook-and-latch-type fastener, such as that sold under the trademark Velcro®. The outer portion of each strap 58 includes the hook portion 62 of the hook-and-latch-type fastener, while the inner portion of the straps 58 includes the latch portion 60 of the fastener. The music holder 18 may also optionally include a third strap 70 attached near the opposite edge of the music holder as described below.

In a manner similar to that described with respect to the music stand holder 16, the music holder 18 may be attached directly to the handle 12 of the musical instrument case 10 by looping the hook portion of the straps 58 under and around the handle 12 on the musical instrument case. The hook portion of each strap 58 then engages the latch portion 60 of the respective straps to maintain the music holder 18 and thus sheet music attached to the musical instrument case 10 (FIG. 4). Both the music stand holder 16 and music holder 18 may be simultaneously attached to the handle 12 of the musical instrument case, thus allowing the musician to carry the musical instrument, music stand, and sheet music using the single handle 12 (FIG. 4).

In addition to being used to individually attach the music stand holder 16 and music holder 18 to the handle 12, the straps 26 and 58 may be used to attach the music holder 18 to the music stand holder 16. The joined carrier 14 may then be placed over the musical instrument case 10 in a saddlebag arrangement as illustrated in FIG. 1. In the saddlebag configuration, the straps 26 and 58 of both the music stand holder 16 and music holder 18, respectively, are passed underneath the handle 12 and subsequently fastened to each other. The straps 26 and 58 are fastened to each other by placing the hook portions 28 of the straps 26 in contact with the latch portions 60 of the straps 58 and the hook portions of the straps 58 in contact with the latch portions 30 of the straps 26, so that they attach the music stand holder 16 to the music holder 18 in a saddlebag configuration. Alternately, instead of passing the straps under the handle 12, the music holder 18 and music stand holder 16 may be attached together as described above and then placed over the musical instrument case 10 in a saddlebag arrangement: so that the straps pass over the top of the handle or on either side of the handle. The straps may also be criss-crossed either underneath or over the top of the handle 12.

In order to ensure that the music stand holder 16 and music holder 18 remain attached to the musical instrument case 10 and do not move excessively on the musical instrument case, it may be advantageous to use strap 38 on music stand holder 16 and strap 70 on music holder 18 to attach the lower edges of the respective holders together. The strap 38 includes an outer portion 40 having the hook portion of a hook-and-latch-type fastener and an inner portion 42 having the latch portion of the fastener. Similarly, the strap 70 includes an outer portion 74 having the hook portion of a hook-and-latch-type fastener and an inner portion 72 having the latch portion of the fastener.

Alter attaching the music stand holder 16 and music holder 18 to the musical instrument case in one of the configurations described above, the straps 38 and 70 are looped underneath the musical instrument case 10 (FIG. 4) and attached to each other by placing the hook portion 40 of the strap 38 in contact with the latch portion of the strap 70 and the hook portion of the strap 70 in contact with the latch portion 42 of the strap 38. The straps 38 and 70 allow the bottom edges of the music stand holder 16 and music holder 18 to be cinched tightly adjacent the musical instrument case 10, thus helping to secure the carrier 14.

When in use, the music stand 50 is placed within the music stand holder 16 and held there by closing the opening 20 using the fastening mechanism and the sheet music is placed in the music holder 18 and held there by closing the opening 52 using the fastening mechanism. The music stand and music holders 16 and 18 are then attached to the musical instrument case 10 in one of the configurations as described above, thus allowing the musician to carry the musical instrument, sheet music, and music stand using the single handle 12 on the musical instrument case.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for carrying a music stand and sheet music on a musical instrument case, the apparatus comprising:

a music stand holder sized to hold a music stand, the music stand holder having a length dimension substantially greater than its width dimension, the music stand holder including:

an opening in one end sized to receive said music stand;

a fastening mechanism located adjacent the opening to releasably close the opening; and at least one flexible elongate strap extending approximately normal to two opposing sides of the music stand holder; and a sheet music holder sized to hold sheet music, the sheet music holder including:

an opening in one end sized to receive said sheet music;

a fastening mechanism located adjacent the opening to releasably close the opening; and at least one flexible elongate strap extending approximately normal to two opposing sides of the sheet music holder, wherein each of said strap on the music stand holder and sheet music holder includes a fastener on an outer portion and on an inner portion, the fasteners being adapted to fasten the outer portion of one strap to an inner portion of any other strap on either the sheet music holder or the music stand holder.

2. The apparatus of claim 1, wherein the music stand holder is adapted to be placed on one side of said musical instrument case and the sheet music holder is adapted to be attached to the opposing side of said musical instrument case, and wherein said strap on the music stand holder is adapted to extend around a portion of said musical instrument case and to connect to said strap on the sheet music holder to attach the sheet music holder and the music stand holder to said musical instrument case in a saddlebag configuration.

3. The apparatus of claim 2 wherein the said straps are adapted to extend around opposing sides of said musical instrument case so that said strap extending from one side of the music stand holder attaches to said strap extending from one side of the sheet music holder, and said strap extending from the opposite side of the music stand holder attaches to said strap extending from the opposite side of the sheet music holder.

4. The apparatus of claim 1, wherein the fasteners are hook and latch type fasteners.

5. The apparatus of claim 1 wherein the music stand holder includes a transparent envelope located on at least one side of the music stand holder and wherein the sheet music holder includes a transparent envelope located on at least one side of the sheet music holder.

* * * * *